US012343588B2

(12) United States Patent
McCarthy

(10) Patent No.: US 12,343,588 B2
(45) Date of Patent: Jul. 1, 2025

(54) FEATHERING HANDLE FOR ROWING MACHINE

(71) Applicant: DJM CONSULTING LLC, Falls Church, VA (US)

(72) Inventor: Dave McCarthy, Falls Church, VA (US)

(73) Assignee: DJM Consulting LLC, Falls Church, VA (US)

( * ) Notice: Subject to any disclaimer, the term of this patent is extended or adjusted under 35 U.S.C. 154(b) by 236 days.

(21) Appl. No.: 18/012,602

(22) PCT Filed: Jun. 23, 2021

(86) PCT No.: PCT/US2021/038632
§ 371 (c)(1),
(2) Date: Dec. 22, 2022

(87) PCT Pub. No.: WO2021/262818
PCT Pub. Date: Dec. 30, 2021

(65) Prior Publication Data

US 2023/0249028 A1 Aug. 10, 2023

Related U.S. Application Data

(60) Provisional application No. 63/043,509, filed on Jun. 24, 2020.

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/4035* (2015.10); *A63B 71/0622* (2013.01);
(Continued)

(58) Field of Classification Search
CPC ..... A63B 22/0076; A63B 21/4035; A63B 71/0622; A63B 69/06; A63B 2022/0079;
(Continued)

(56) References Cited

U.S. PATENT DOCUMENTS 5,076,578 A 12/1991 Askonen
5,921,904 A * 7/1999 Toups ..... A63B 21/4035 482/121

(Continued)

OTHER PUBLICATIONS

International Search Report and Written Opinion of the ISA for PCT/US2021/038632 dated Nov. 4, 2021, 18 pages.

*Primary Examiner* — Andrew S Lo
(74) *Attorney, Agent, or Firm* — Joshua B. Brady; Nixon & Vanderhye, P.C.

(57) ABSTRACT

A rowing machine to simulate the action of rowing a watercraft includes an energy damper, a handle, and a tensile member connecting the handle to the energy damper. The handle includes a grip member with a right hand grip and a left hand grip, and a connecting member connected to the tensile member. The connecting member is configured to transmit a force from the tensile member to the handle such that the force is substantially centered between the left hand grip and the right hand grip. The grip member is configured to rotate relative to the connecting member and provide at least one of a haptic indication and an audible indication when the grip member rotates relative to the connecting member from a first position to a second position that is substantially ninety degrees from the first position. The simulation may include actions to replicate feathering an oar.

8 Claims, 19 Drawing Sheets

(51) Int. Cl.
*A63B 69/06* (2006.01)
*A63B 71/06* (2006.01)

(52) U.S. Cl.
CPC ..... *A63B 2022/0079* (2013.01); *A63B 2022/0084* (2013.01); *A63B 69/06* (2013.01); *A63B 2071/0625* (2013.01); *A63B 2071/0655* (2013.01)

(58) Field of Classification Search
CPC .... A63B 2022/0084; A63B 2071/0625; A63B 2071/0655; A63B 2069/066; A63B 2071/069
See application file for complete search history.

(56) References Cited

U.S. PATENT DOCUMENTS

| | | | | |
|---|---|---|---|---|
| 10,426,994 | B1 * | 10/2019 | Campanaro | A63B 21/068 |
| 10,471,297 | B1 * | 11/2019 | Smith | A63B 22/0076 |
| 12,064,661 | B2 * | 8/2024 | Hales | A63B 21/0552 |
| 2010/0113234 | A1 | 5/2010 | Kristiansen | |
| 2016/0375297 | A1 | 12/2016 | Kiser | |
| 2017/0157457 | A1 | 6/2017 | Kurabieski et al. | |
| 2018/0207473 | A1 | 7/2018 | McCullough | |
| 2019/0351283 | A1 | 11/2019 | Smith et al. | |
| 2020/0261765 | A1 * | 8/2020 | Jones | A63B 22/0005 |
| 2020/0282256 | A1 * | 9/2020 | Boyles | A63B 21/4015 |
| 2021/0154522 | A1 * | 5/2021 | Wu | A63B 21/4043 |
| 2021/0354002 | A1 * | 11/2021 | Schaefer | A63B 71/0622 |

* cited by examiner

FEATHERING HANDLE FOR ROWING MACHINE

CROSS-REFERENCE TO RELATED APPLICATIONS

This application is the U.S. national phase of International Application No. PCT/US2021/038632 filed Jun. 23, 2021 which designated the U.S. and claims priority to U.S. Provisional Patent Application No. 63/043,509 filed Jun. 24, 2020, the entire contents of each of which are hereby incorporated by reference.

BACKGROUND

Rowing is a sport in which one or more people, typically one to eight people, use oars to propel a boat through water. These boats are known as sculls or shells. Competitive rowing teams may not be able to practice rowing on water due to various circumstances. For example, the rowing teams may be located in areas where the water might be frozen or at an unsafe temperature (i.e., too cold) during at least part of the year. It may be too windy, too rainy or there may be too much debris in the water to safely row the boat. One familiar with rowing may appreciate many conditions that could result in water that is not safe for rowing. Further, it may be desirable to practice rowing in locations where water is not accessible.

In order to practice rowing, rowing machines have been developed. Such machines are also known as ergometers or ergs. The rowing machines are intended to replicate the motion and effort, typically for a single or multiple persons, of rowing a boat. Common rowing machine designs include an energy damper (or braking mechanism) connected to a handle by way of a chain, strap or belt. Footrests are typically attached to the same mounting as the energy damper. A seat mounted to a rail allows the seat to move and, together with movement of the handle connected to the energy damper, replicates much of the rowing movement experienced in a boat.

BRIEF SUMMARY

Rowing technique is important to maximizing or improving efficiency of the rower, whether it be in a single-person boat or a boat with multiple rowers. Rowers and rowing coaches are constantly pursuing methods for gaining an 'edge' over the competition and maximizing results from on- an off-water practice time. Rowing machines provide a good platform for practicing the overall rowing motions (e.g., leg and arm motions) for propelling the boat. However, feathering and squaring the oars is one critical aspect of the rowing motion that is not recreated with common rowing machines nor practiced off-water.

Feathering is the process of rotating the oar approximately ninety degrees from a squared position (i.e., the power stroke where the blade of the oar is in the water to achieve forward thrust and preferably perpendicular to the surface of the water) and the feathered position (i.e., the return stroke where the blade of the oar is out of the water and preferably substantially parallel to the surface of the water). Feathering occurs both for a sculler (a person that uses two independent oars) and for a sweeper (a person that uses one single oar). A sculler will feather two independent oars whereas a sweeper will feather only one oar.

The present disclosure includes devices and methods to include a feathering motion with a rowing machine. This is advantageous because adding the feathering motion allows practice to better replicate the motion used in a boat. In turn, if a team practices on multiple rowing machines simultaneously, the team can synchronize the feathering aspects of the stroke as well.

Even for a single person, a device with one or more aspects of the disclosure will allow that person to practice a feathering technique using a rowing machine.

In a first example, a rowing machine to simulate the action of rowing a watercraft includes an energy damper, a handle, and a tensile member connecting the handle to the energy damper. The handle includes a grip member with a right hand grip and a left hand grip, and a connecting member connected to the tensile member. The connecting member is configured to transmit a force from the tensile member to the handle such that the force is substantially centered between the left hand grip and the right hand grip. The grip member is configured to rotate relative to the connecting member and provide at least one of a haptic indication and an audible indication when the grip member rotates relative to the connecting member from a first position to a second position that is substantially ninety degrees from the first position.

In further examples, (a) the handle includes a housing with a through hole, the grip member extends through the through hole, and the housing is connected to the connecting member, (b) the through hole includes a first flat surface and a second flat surface that together form a ninety degree angle and that are both parallel to a central axis of the hole, (c) the grip member includes a third flat surface parallel to the central axis of the hole, the third flat surface abutting the first flat surface in the first position and abutting the second flat surface in the second position, (d) the tensile member and the handle are configured so that the tensile member is perpendicular to one of the first flat surface and the second flat surface when a user places the tensile member in tension by pulling on the handle, (e) at least one of the grip member and the connecting member includes a detent that resists rotation between the grip member and the connecting member when the grip member is at the first position and at the second position, (f) the detent includes a spring loaded ball, (g) the connecting member includes a sculling oarlock, (h) the grip member includes a tube or cylinder within an oar sleeve, (i) the grip member is configured to rotate relative to the connecting member more than ninety degrees, and/or (j) the grip member is configured to rotate relative to the connecting member away from the first position to beyond the second position and away from the second position to beyond the first position.

In a second example, a handle for use with a rowing machine includes a right grip portion at a first end of the handle, a left grip portion at a second end of the handle, and a sleeve with a connection for a tensile member. The connection is configured to transmit a force to the handle that is substantially centered between the left grip portion and the right grip portion. The left grip portion is rotationally fixed to the right grip portion such that the left grip portion and the right grip portion rotate in unison with respect to the sleeve. Rotation of the left grip portion and the right grip portion from a first position to a second position relative to the sleeve provides at least one of a haptic indication and an audible indication. The first position and the second position are substantially ninety degrees apart.

In further examples, (a) the sleeve includes an interior passage extending through the length of the sleeve, the left grip portion and the right grip portion are portions of a continuous member, and the continuous member extends through the interior passage, (b) the sleeve includes an interior passage extending through the length of the sleeve with a first flat surface and a second flat surface that together form a ninety degree angle and that are both parallel to a central axis of the interior passage, (c) the right grip portion and the left grip portion are connected by an intermediate portion, and the intermediate portion includes a third flat surface parallel to the central axis that abuts the first flat surface in the first position and abuts the second flat surface in the second position, (d) the handle also includes a detent that resists rotation at the first position and at the second position, (e) the detent is part of the sleeve, (f) the sleeve includes a first recess that receives the detent at the first position and a second recess that receives the detent at the second position, and/or (g) the left grip portion and the right grip portion are rotatable 360° relative to the sleeve.

In a third example, a handle for use with a rowing machine includes a right grip portion at a first end of the handle, a left grip portion at a second end of the handle, and a central portion between the left grip portion and the right grip portion and including a connection for a tensile member. The connection is configured to transmit a force to the handle that is substantially centered between the left grip portion and the right grip portion. The left grip portion and the right grip portion are separately rotatable with respect to the central portion. The left grip portion and the right grip portion are each rotatable from a first position to a second position relative to the central portion. The first position and the second position are substantially ninety degrees apart, and rotation from the first position to the second position provides at least one of a haptic indication and an audible indication.

In further examples, (a) the right grip portion and the left grip portion are rotationally connected to one another, (b) right grip portion is rotationally coupled to the central portion and the left grip portion is separately rotationally coupled to the central portion, (c) the handle also includes a first detent for the right grip portion and a second detent for the left grip portion, (d) the right grip portion includes the first detent and the left grip portion includes the second detent, and/or (e) the central portion includes the first detent and the second detent.

DETAILED DESCRIPTION

Figure 1:
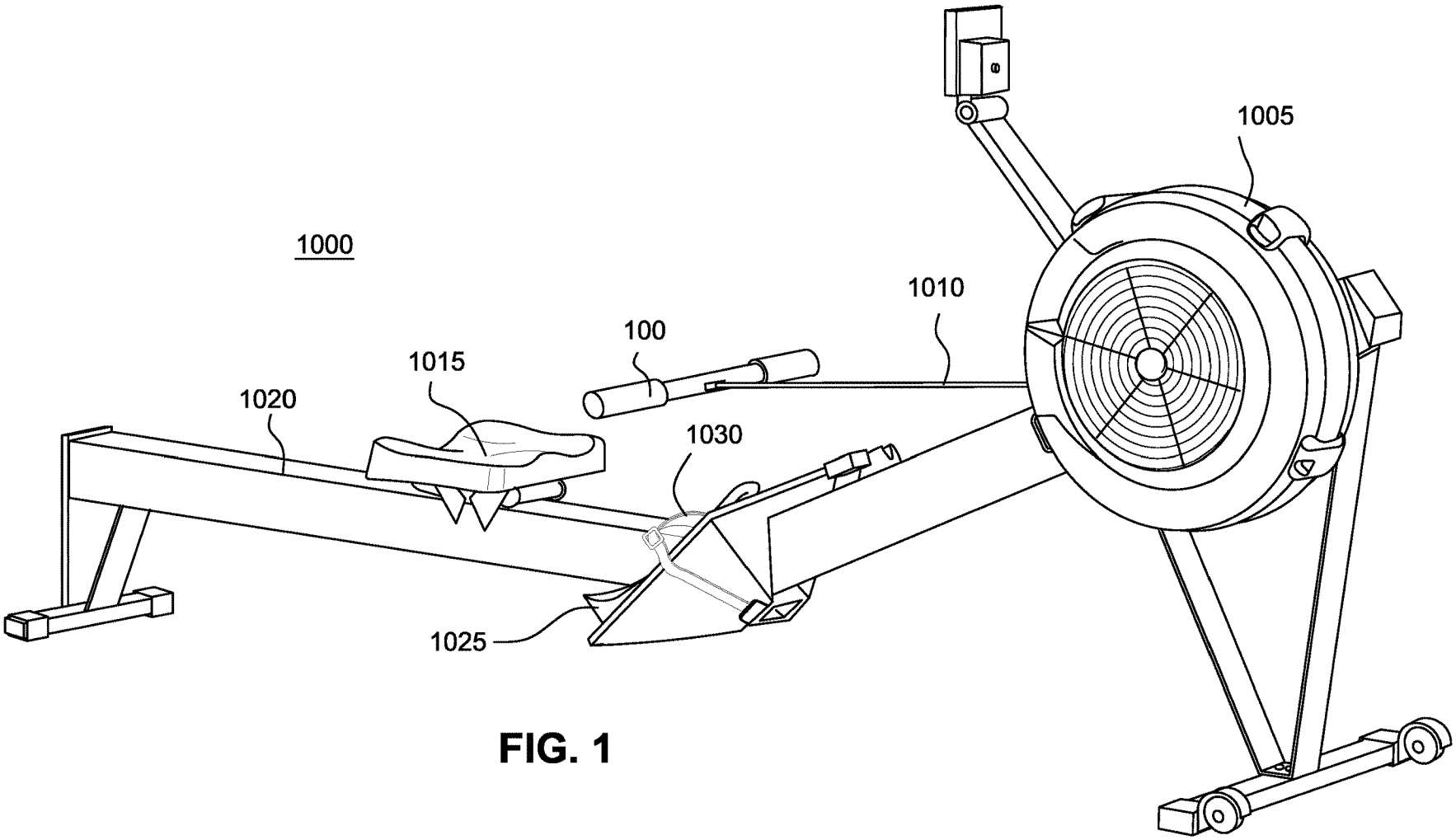
FIG. 1 is a rowing machine with a handle.

FIG. 1 illustrates a rowing machine 1000 or erg, which includes an energy damper 1005 connected to a handle 100 by way of a tensile member 1010. A seat 1015 can slide on a rail 1020 (or rails) when a user pushes against the footrest 1025. Straps 1030 on the footrest 1025 allows a user to move the seat 1015 towards the energy damper 1005.

The energy damper 1005 can be any suitable device for providing resistance to (and thus dissipating energy from) a user. Typical forms may be a rotating fan, a container with impellers in a closed volume of water, or a rotating wheel with a friction element (e.g., mechanical brake). Each of these forms are similar in that there is a rotating element, which allows for both storage and dissipation of rotational energy in order to mimic the momentum of a boat on water. The energy damper 1005 does not need to include a rotational element, but the ability to mimic the momentum of a boat on water is preferable.

The tensile member 1010 may be a chain, strap, belt or any similarly suitable structure that can transmit force from the handle 100 to the energy damper 1005. A chain, strap and belt are similar in that they are flexible and allow the application of force in a tensile direction but have little or no capability to transmit force in compression. When used in conjunction with an energy damper 1005 that stores rotational energy, the continued rotation of the rotational element can be used to retract a length of the tensile member 1010 during a return stroke (i.e., when the tensile member 1010 is not under a tensile load).

The handle 100 is illustrated in a simplified or conventional form in FIG. 1. Various forms of the handle 100 are discussed in detail below.

Figure 2:
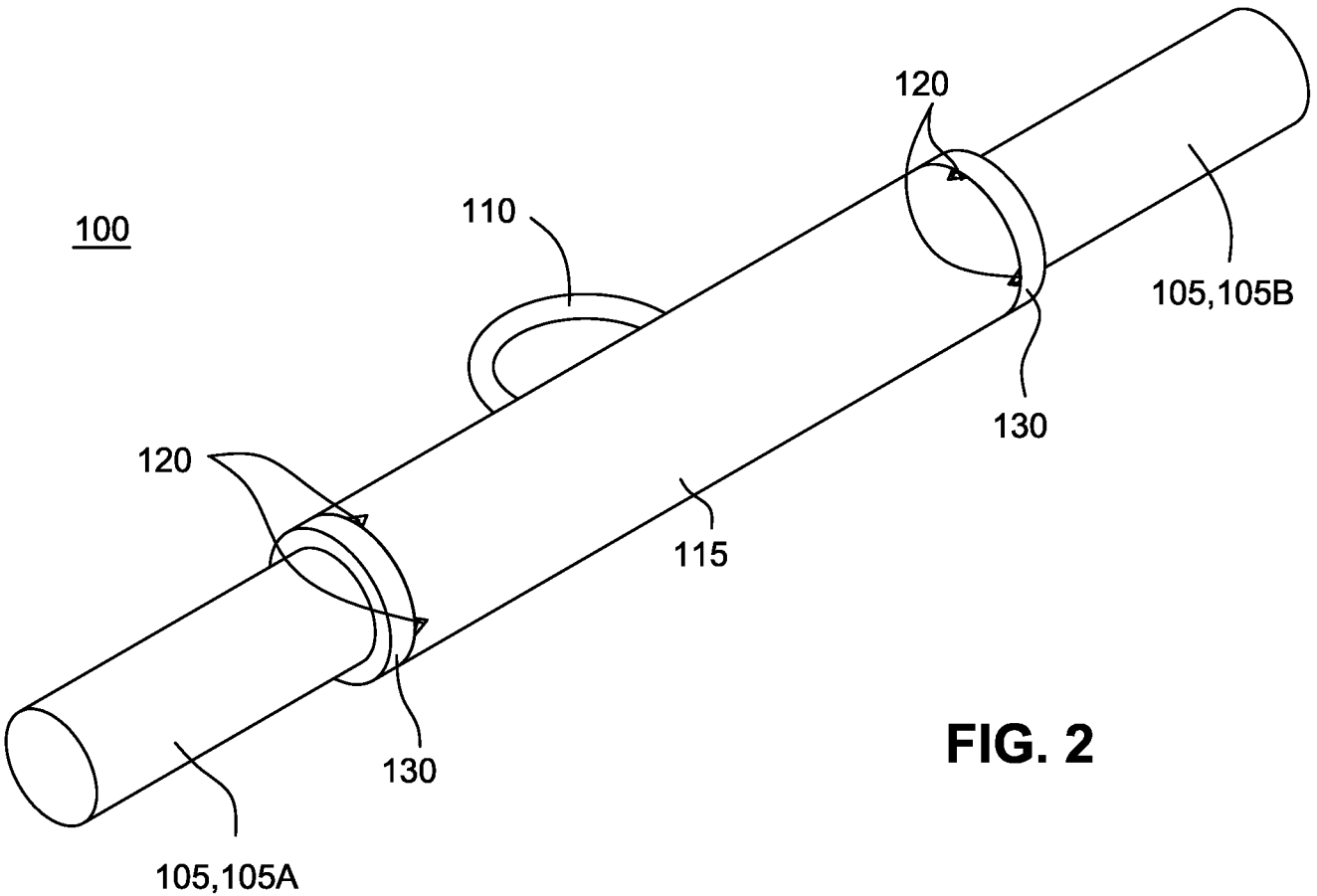
FIG. 2 is a perspective view of a handle for use with a rowing machine.
Figure 3:
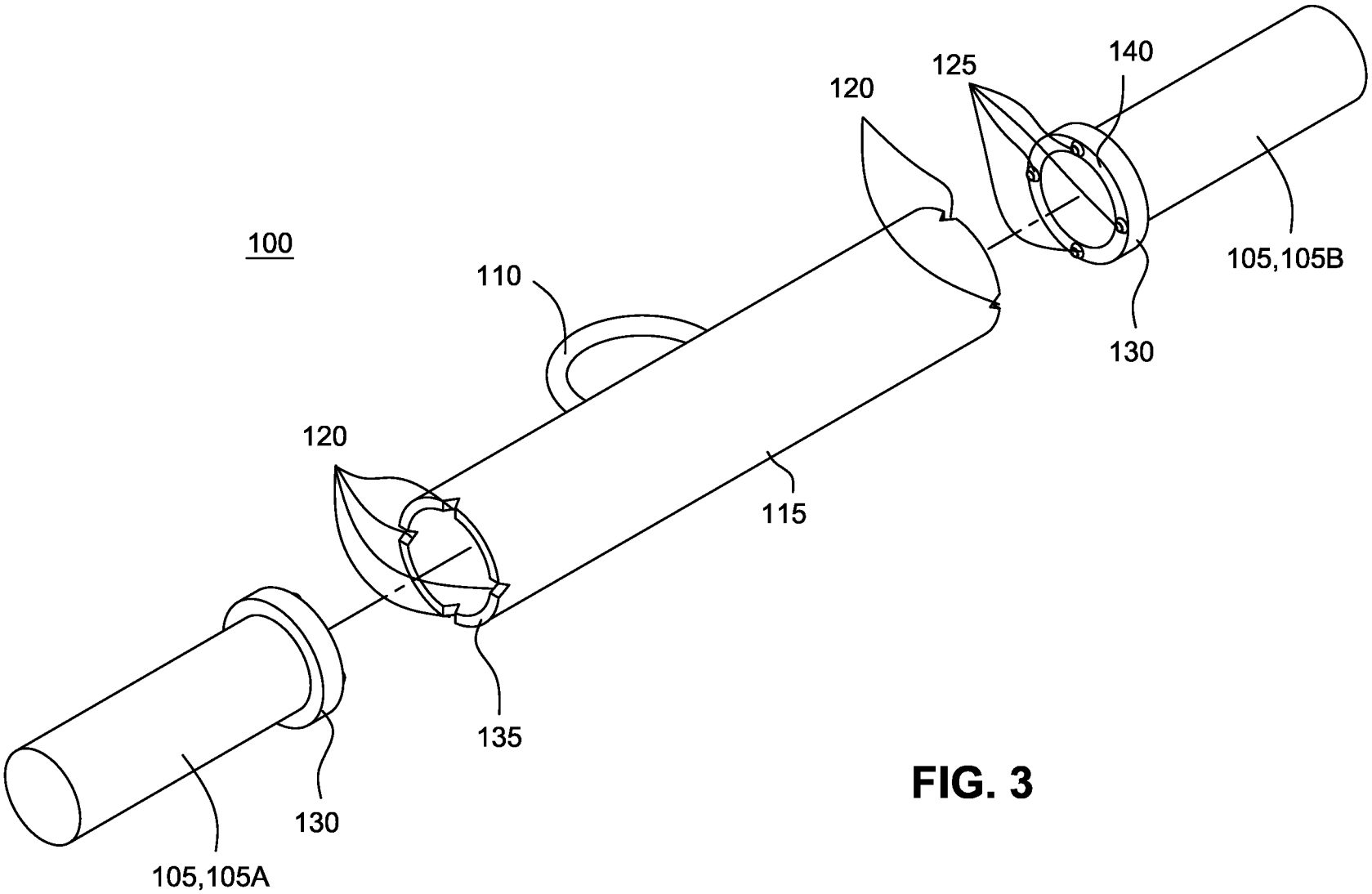
FIG. 3 is an exploded view of the handle of FIG. 2.
Figure 4:
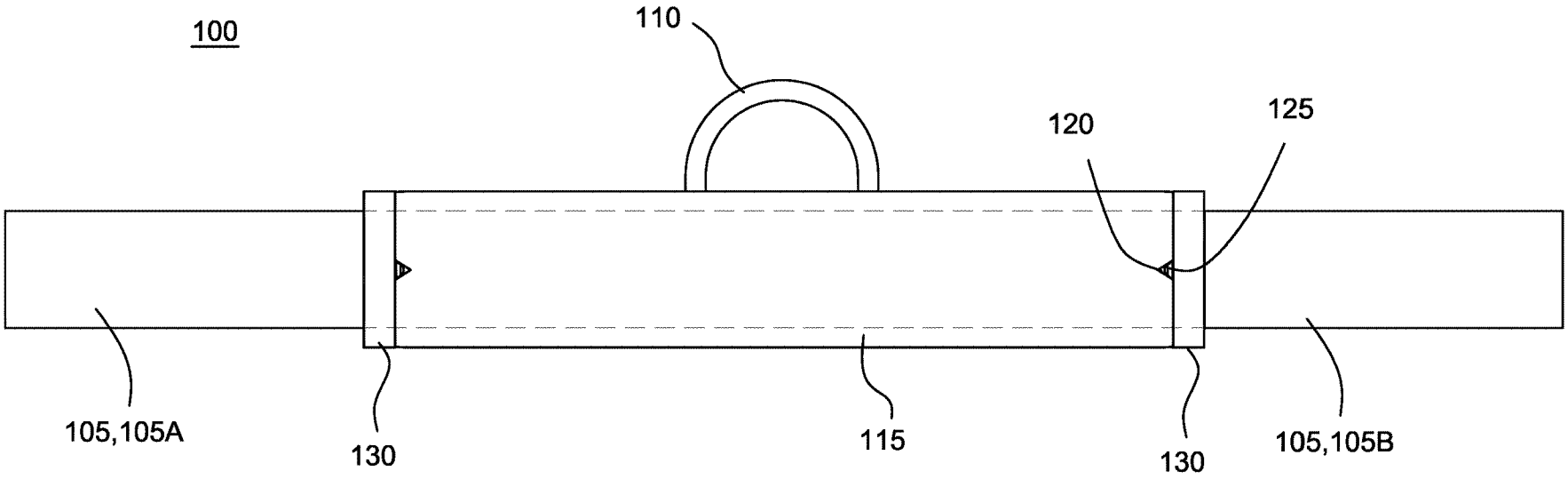
FIG. 4 is another view of the handle of FIG. 2.

FIGS. 2-4 illustrate a handle 100 with a grip member 105, which includes a left grip 105A and a right grip 105B. As used herein, left and right are used to differentiate one grip from another and should not be considered limiting. Unless expressly noted otherwise, the grips are identical and a left grip could be gripped by a right hand and a right grip could be gripped by a left hand.

A connecting member 110 provides a structure for connecting the handle 100 to the tensile member 1010. The connecting member 110 is illustrated as half of a circular ring but could take any form suitable for connecting the handle 100 to the tensile member 1010. For example, the connecting member could be a hook, an eye bolt, an eye bolt with a ring through the eye (i.e., a ring bolt) or similar anchor element. Any structural element that can transmit a force from the tensile member 1010 to the handle 100 may be utilized. The connecting member 110 is illustrated substantially centered between opposite ends of the handle 100. It is preferable that the connecting member 110 be located such that force transmitted between the handle 100 and the tensile member 1010 is substantially centered between the left grip 105A and the right grip 105B because the handle 100 will be balanced between a user's hands when using the rowing machine 1000 in a conventional manner. Thus the connecting member 110 may not be centered between opposite ends of the handle 100 if the left grip 105A and the right grip 105B are not symmetrical with respect to a middle of the handle 100. An alternative way to balance the handle 100 would be providing connections to the tensile member 1010 at opposed ends of the handle and/or outside of the left grip 105A and the right grip 105B, which could result in the connecting member 110 being two components. When the connecting member 110 is connected to the tensile member 1010 and the tensile member 1010 is in tension, the connecting member 110, and anything rigidly connected thereto, is able to resist rotation relative to the tensile member 1010.

The handle 100 includes an intermediate portion 115 between the left grip 105A and the right grip 105B and to which the connecting member 110 is connected. The intermediate portion 115 is in the form of a sleeve or tubular housing and thus includes a central aperture through which the grip member 105 extends. The central aperture is visible in FIG. 3, but the portion of the grip member 105 extending between the left grip 105A and the right grip 105B has been omitted for clarity.

The handle 100 includes elements to provide least one of a haptic indication and an audible indication when the grip member 105 rotates relative to the intermediate portion 115, and thus relative to the connecting member 110, from a first position to a second position. In this embodiment, the elements include notches 120 and detents 125. The detents 125 are in flanges 130 associated with the left grip 105A and the right grip 105B, and the notches 120 are in respective axial ends of the intermediate portion 115. The positions of the detents 125 and the notches 120 may be interchanged between flanges 130 and the intermediate portion 115. Also, the flanges 130 may be omitted if, for example, there is adequate material to include the detents 125 and/or notches 120. Whether the flanges 130 are included may be based upon the size (e.g., diameter) of the left grip 105A and right grip 105B best suited for simulating the feel of an oar.

The detents 125 are components that hold the left grip 105A and right grip 105B relative to the intermediate portion 115 such that the position can be changed by applying a rotational force. The detents 125 may be a component that fits within the notches 120, and preferably allows a user to feel or hear when the detents 125 are moved into an engaged state with the notches 120. One example of a detent is a ball sized to fit into the notches 120 and biased toward the notches 120 with a spring. This may be in the form of a set screw with a spring loaded ball, which is available from Nabeya Bi-tech Kaisha (NBK) of Japan. Alternatively, the left grip 105A and the right grip 105B may include protrusions sized to interface with the notches 120 and the left grip 105A and the right grip 105B may be biased towards the notches 120. As illustrated, there are four each of the notches 120 and detents 125 equally spaced so that engagement occurs every 90° of rotation. Although 90° of rotation is discussed herein, other amounts of rotation may be employed. For example, the amount of rotation in a feathering motion could be 45°, 80°, 100° or any amount of rotation that adequately provides for removal of the blade of the oar from the water during the return stroke. Thus reference to 90° is exemplary and one of ordinary skill will appreciate that other amounts of rotation may be employed with various embodiments discussed herein.

When the notches 120 and detents 125 engage, the user can feel the engagement and/or hear a sound such as a click. Thus a user can rotate the grip member 105 while using the rowing machine 1000 and receive haptic and/or audible indication that the grip member 105 has been rotated to simulate feathering an oar. This may help the user to develop muscle memory for the feathering movement and the timing of the feathering movement with the overall rowing stroke and recovery. The audible feedback may also allow other users and/or a coach to hear whether feathering motions occur simultaneously across team members practicing on adjacent rowing machines.

Although four pairs of notches 120 and detents 125 are illustrated for each of the left grip 105A and the right grip 105B, it will be appreciated that a single detent 125 could be used with a pair of notches 120 spaced 90° apart. Any combination that allows a user to rotate from a first position to a second position 90° from the first position may be employed. Of course, values other than 90° may be employed if a user desires to practice a feathering motion at some other rotational amount.

Also, the orientation of the notches 120 and detents 125 relative to the axis of rotation may be changed. As illustrated, the notches 120 and detents 125 are respectively located in surfaces 135, 140. The surfaces 135, 140 are perpendicular to an axis of rotation of the grip member 105. With this configuration, the detents 125 have an axis of actuation that is parallel to the axis of rotation. However, the orientations of the notches 120 and/or detents 125 could be different. For example, the detents 125 could be oriented have their axis of actuation perpendicular to the axis of rotation of the grip member 105. This would require the notches 120 and the detents 125 to be in portions of the grip member 105 and intermediate portion 115 that axially overlap.

The grip member 105 is illustrated as solid from end to end in FIGS. 2-4. However, it could be a tube which may be preferable in that raw material and weight can be reduced. Polymers, such as polyvinyl chloride (PVC), may provide a reasonable balance of weight and strength for the grip member 105 and the intermediate portion 115.

The overall length of the handle 100 is preferably about the average shoulder width of an adult. Twenty inches may be a suitable length, but any overall length that allows a user to replicate a rowing motion may be employed. The diameter of the left grip 105A and the right grip 105B should be chosen to replicate an oar. Diameters around 1.5 or 2.0 inches may be suitable.

Figures 5, 6:
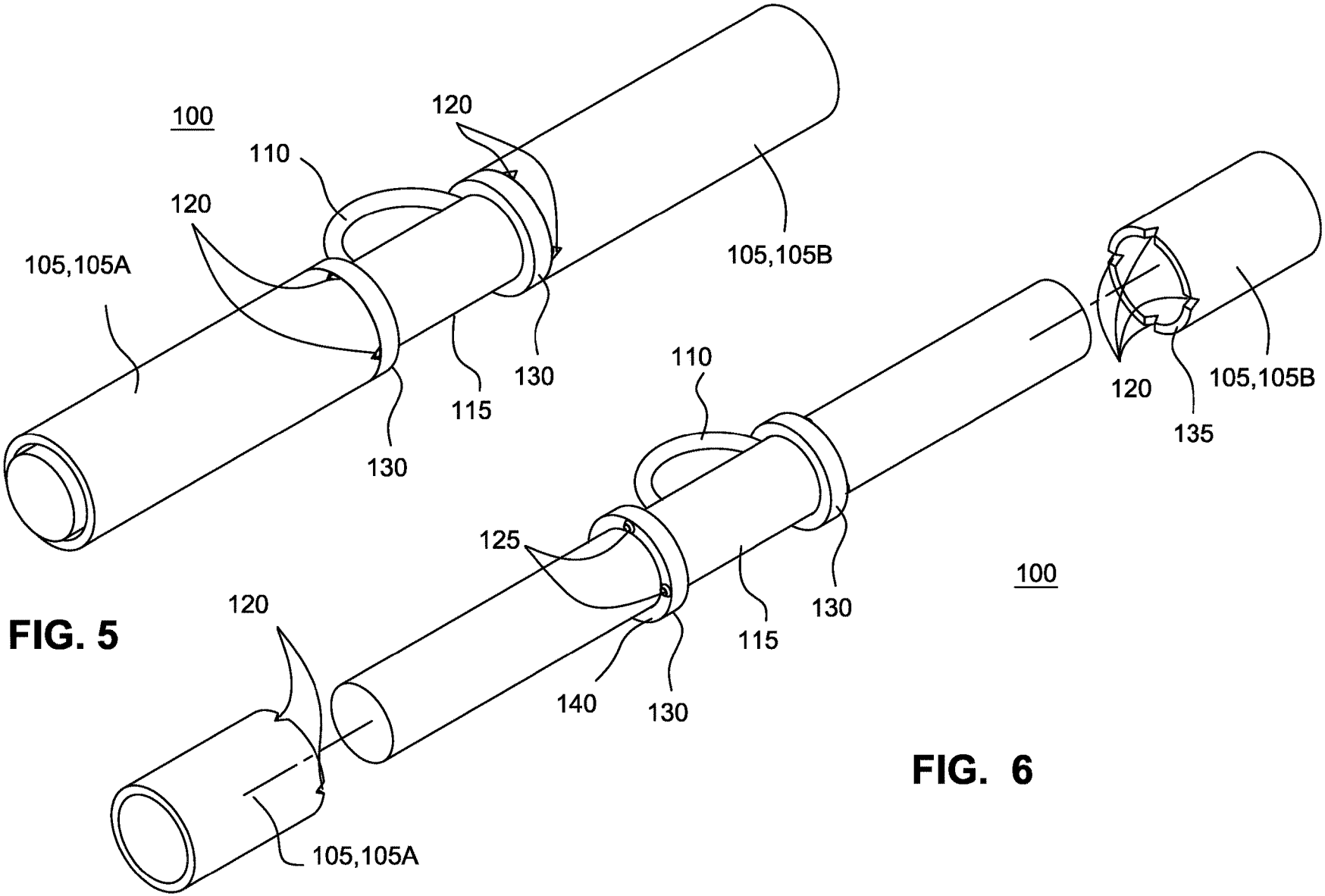
FIG. 5 is a perspective view of another handle for use with a rowing machine.
FIG. 6 is an exploded view of the handle of FIG. 5.
Figure 7:
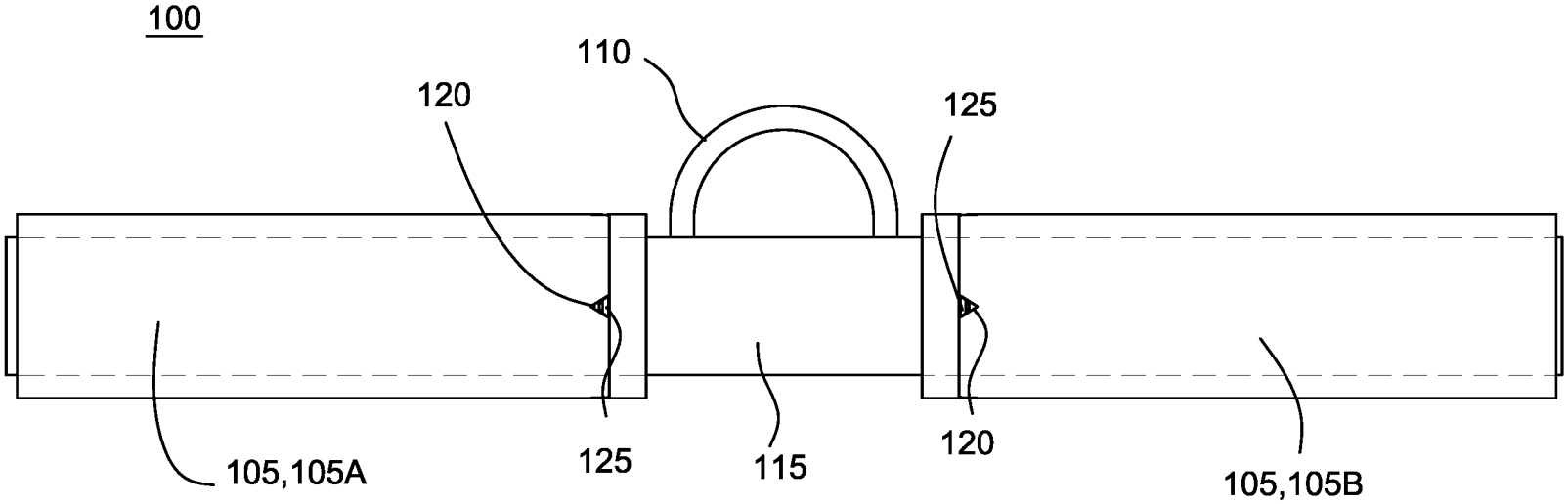
FIG. 7 is another view of the handle of FIG. 5.

FIGS. 5-7 illustrate a handle 100 with some features different from those previously described. Where the features are identical, their description is omitted for brevity.

In FIGS. 5-7, the primary difference lies in that the intermediate portion 115 is interior to the left grip 105A and the right grip 105B, which allows for the left grip 105A and the right grip 105B to be exterior to, and rotate about, the intermediate portion 115. In this configuration, the left grip 105A and the right grip 105B can rotate independently of one another. Such independent rotation may be preferable for practicing feathering motions where the user controls two oars (e.g., practicing as a sculler).

Figure 8:
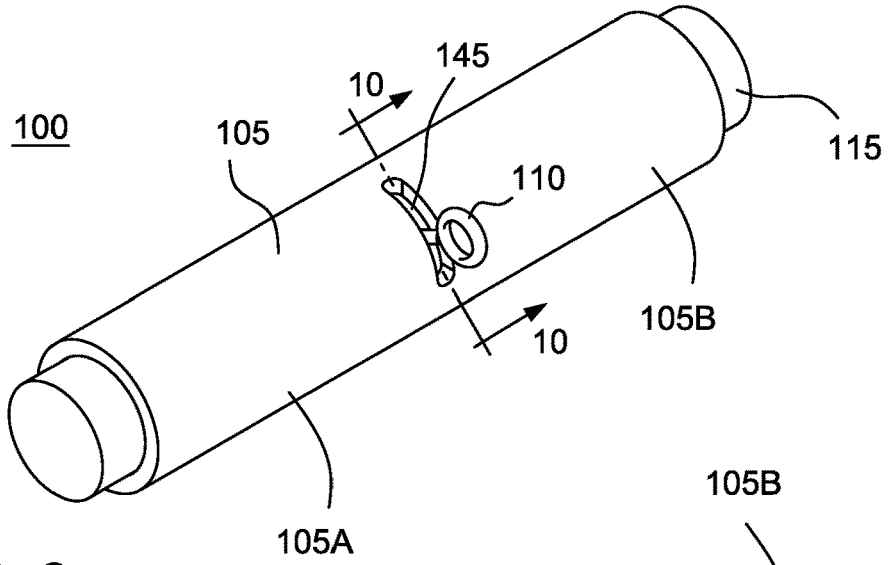
FIG. 8 is a perspective view of another handle for use with a rowing machine.
Figure 9:
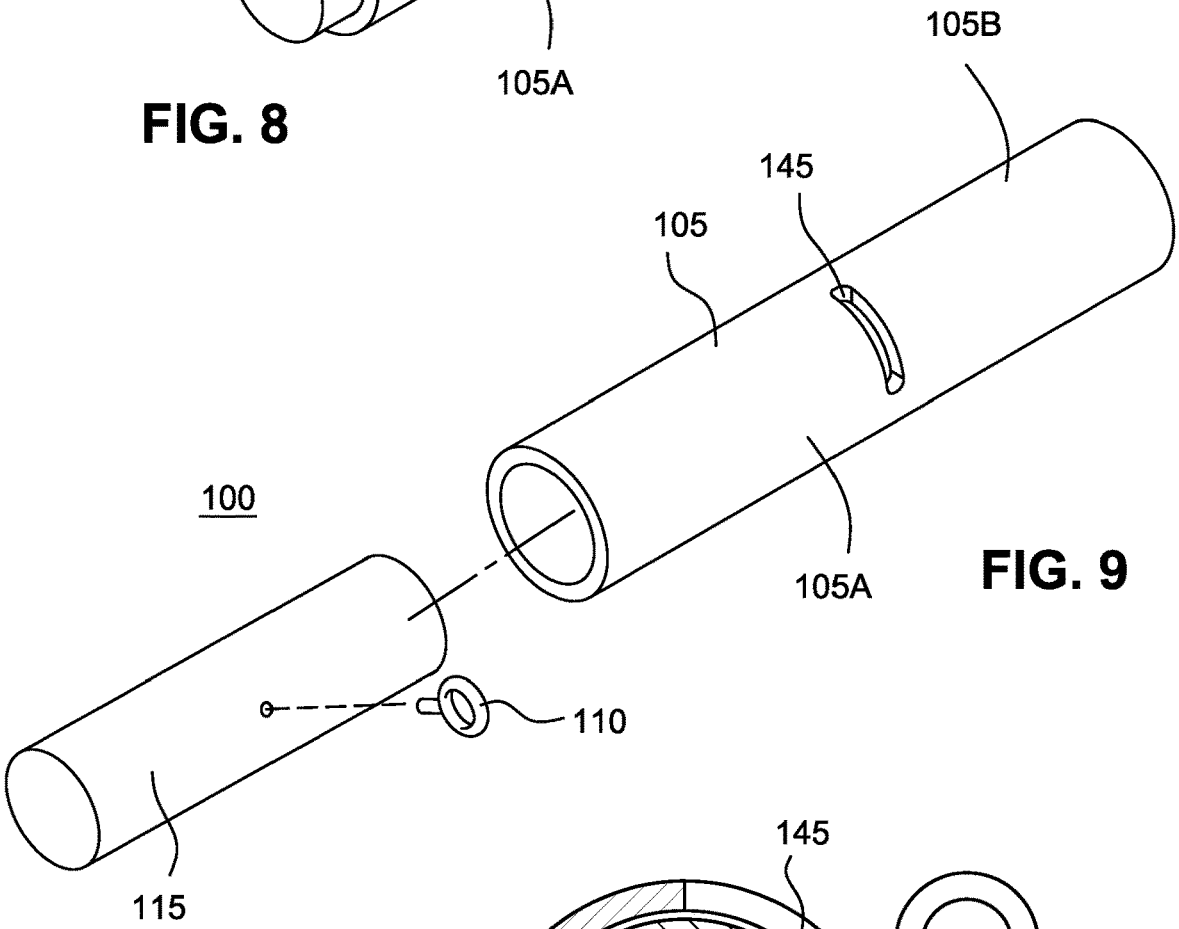
FIG. 9 is an exploded view of the handle of FIG. 8.
Figure 10:
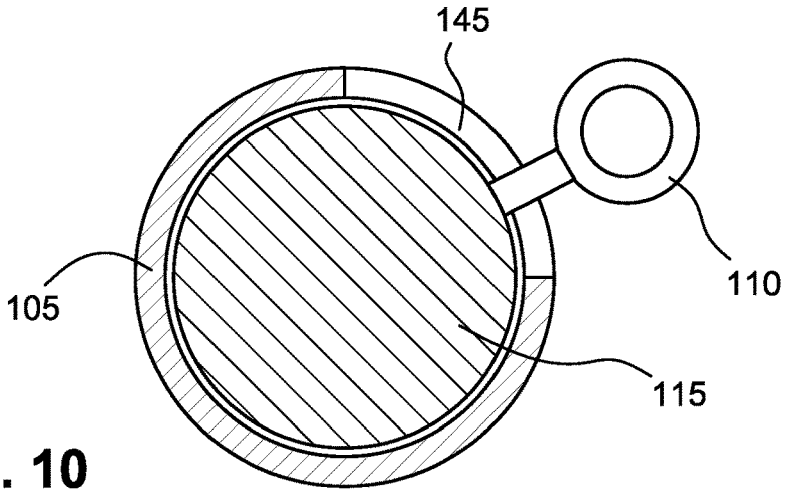
FIG. 10 is a cross-section of the handle of FIG. 8.
Figure 11:
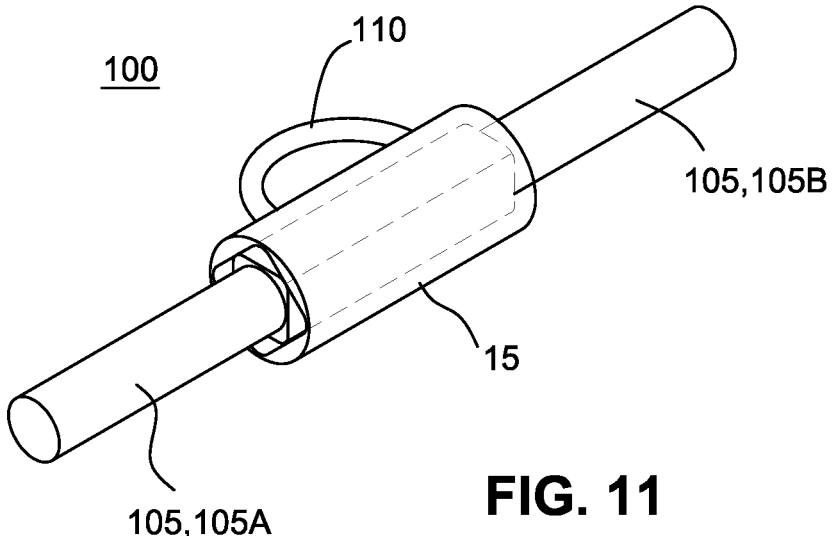
FIG. 11 is a perspective view of another handle for use with a rowing machine.
Figure 12:
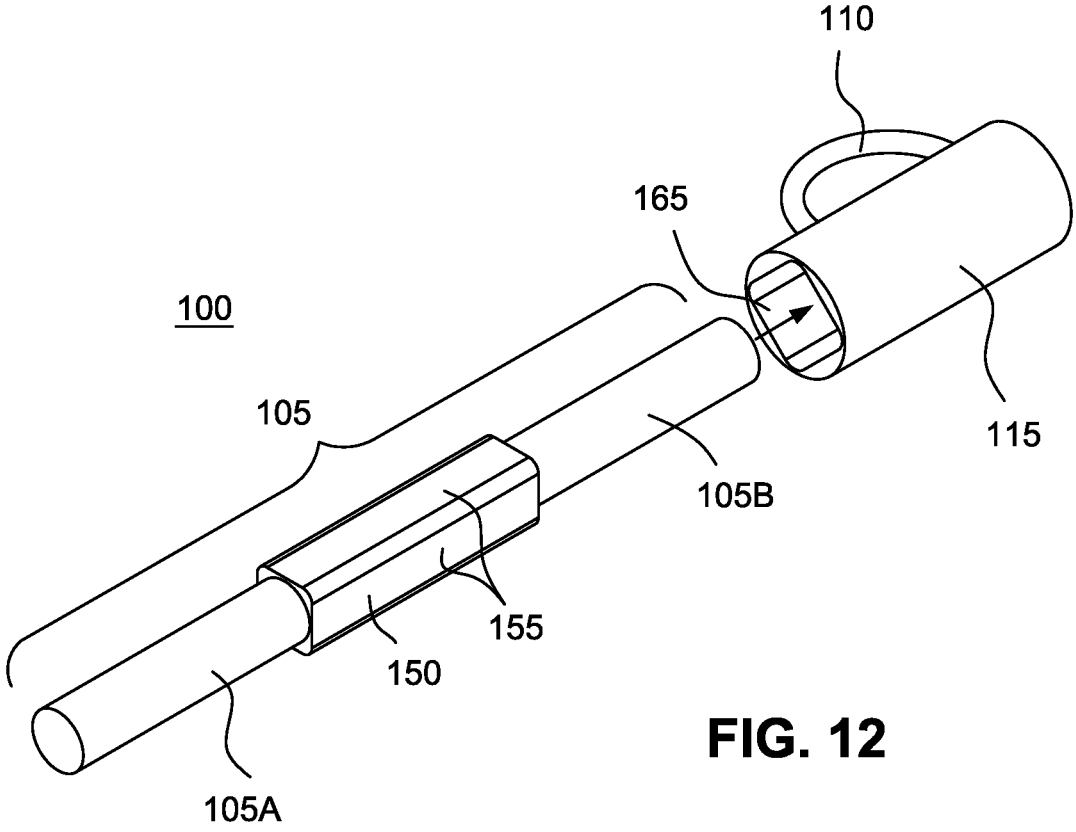
FIG. 12 is an exploded view of the handle of FIG. 11.

FIGS. 8-10 illustrate a handle 100 in another configuration. The grip member 105 is in the form of a tube extending from the left grip 105A to the right grip 105B. A groove 145 is substantially in the middle of the grip member 105. As best seen in FIG. 9, the groove 145 extends approximately 90° around the perimeter of the grip member 105 and fully through its thickness. The connecting member 110 is in the form of an eye bolt extending through the groove 145 and connected to the intermediate portion 115.

In this configuration, the grip member 105 rotates about the intermediate portion 115. The combination of the groove 145 and the connecting member 110 restrict relative rotation to the extents of the groove 145, e.g., to 90°. When at the limits of rotation, haptic and/or audible indication may occur by the connecting member 110 impacting the end of the groove.

However, it may be desirable to allow a user to rotate more than 90° as is possible in an oar lock. If rotation beyond 90° is desired, it is possible to provide haptic and/or audible indication. The groove 145 may be greater than 90°, e.g. 120° or 180°. Mechanisms are then included within the groove 145 at positions 90° apart. For example, detents (not illustrated in FIGS. 8-10) similar to those discussed above may be located to allow 90° of rotation and rotation beyond 90° could occur with adequate force applied to overcome the detent. Of course, any element that provides the desired haptic and/or audible indication may be used in place of a detent.

FIGS. 11-14 illustrate another configuration of the handle 100 that differs primarily in the way that haptic and/or audible indications are provided. This configuration differs from that illustrated in FIGS. 2-4 primarily in that grip member 105 includes a medial portion 150 with four surfaces 155 that form a substantially square profile with rounded corners. Adjacent surfaces 155 thus form a 90° angle. The intermediate portion 115 includes a through-hole 165 with four surfaces 160 that are also in the form of a substantially square profile with rounded corners. Adjacent surfaces 160 thus form a 90° angle. The through-hole 165 is sized such that the medial portion 150 can rotate substantially unimpeded within the through-hole 165. This configuration is similar to the configuration in sculling oar locks and sweeping oar locks in that when the handle 100 (similar to an oar) is under load, a surface 155 of the medial portion 150 will tend to be flush against a surface 160 of the through-hole 165. When the handle 100 is rotated 90° to mimic feathering an oar, at least one of the surfaces 155 should abut a surface 160 of the through-hole 165. This rotation will provide haptic and/or audible indication when the surfaces mate.

Figure 13:
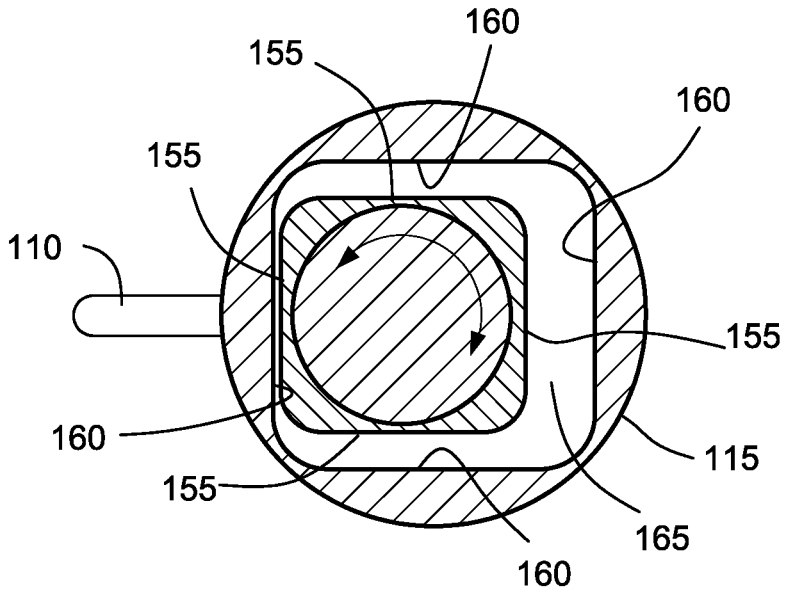
FIGS. 13 and 14 are cross-sections of the handle of FIG. 11 illustrating different rotational positions.
Figure 14:
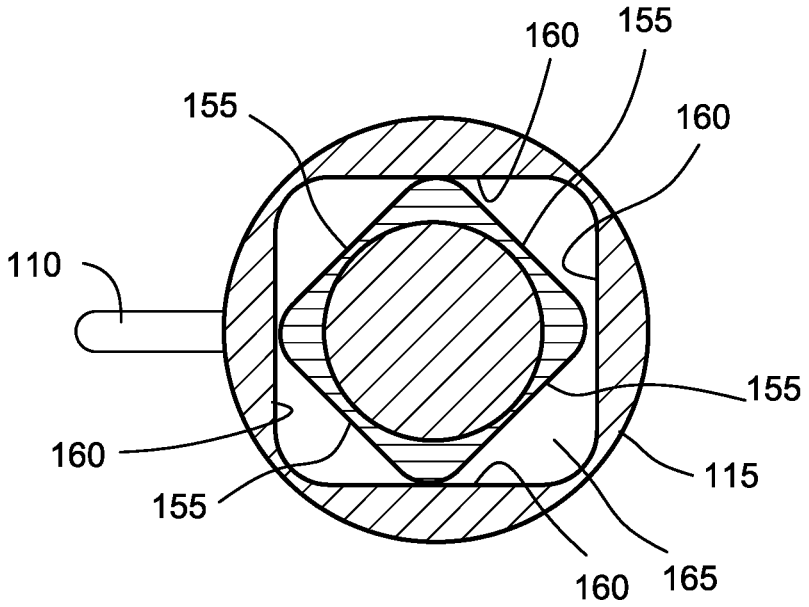

As best seen in FIGS. 13 and 14, the connecting member 110 is oriented to apply a load to the handle 100 in a direction that is substantially perpendicular to a nearest one of the surfaces 160. This configuration should urge one of the surfaces 155 to abut the surface 160 opposite to the connecting member 110 when the handle 100 places the tensile member 1010 under load.

The configuration illustrated in FIGS. 15-25 includes many "off the shelf" components and is functionally similar to the configuration in FIGS. 11-14.

The grip member 105 may be a tube or cylinder with an oar sleeve 170 as used on an oar for a scull or sweep. Two oar locks 175 (either a scull oarlock or a sweep oarlock, both available from at https://shop.concept2.com/) are connected together by the connecting member 110 (which may be in the form of a U-bolt). Three sweep collars 180 (available from at https://shop.concept2.com/) are fixed to the oar sleeve 170 with clamps (e.g., hose clamps) such that one of the collars 180 is between the two oar locks 175 and the other two collars 180 are on opposed ends of the oar sleeve 170 to bound and retain the two oar locks 175. Off the shelf components may need to be chosen to correctly to ensure that the oar sleeve 170, oar locks 175 and sweep collars 180 are sized to function together because scull oarlocks and sweep oarlocks, and the corresponding oar sleeves and collars, may be sized differently.

As will be appreciated by one of ordinary skill, all three of the collars 180 may not be required to retain the oar locks 175. For example, only the middle collar 180 may be provided because the connecting member 110, which connects the oar locks 175 together, will prevent the oar locks 175 from unintentionally being removed from the handle 100 due to the connection of the oar locks 175. Similarly, the middle collar 180 may be omitted, in which case the two outer collars 180 will retain the two oar locks 175.

With this configuration, the feathering motion will result in haptic and/or audible indications that are substantially identical to what would be encountered using an oar on a scull or shell because the same components are used.

Figure 15:
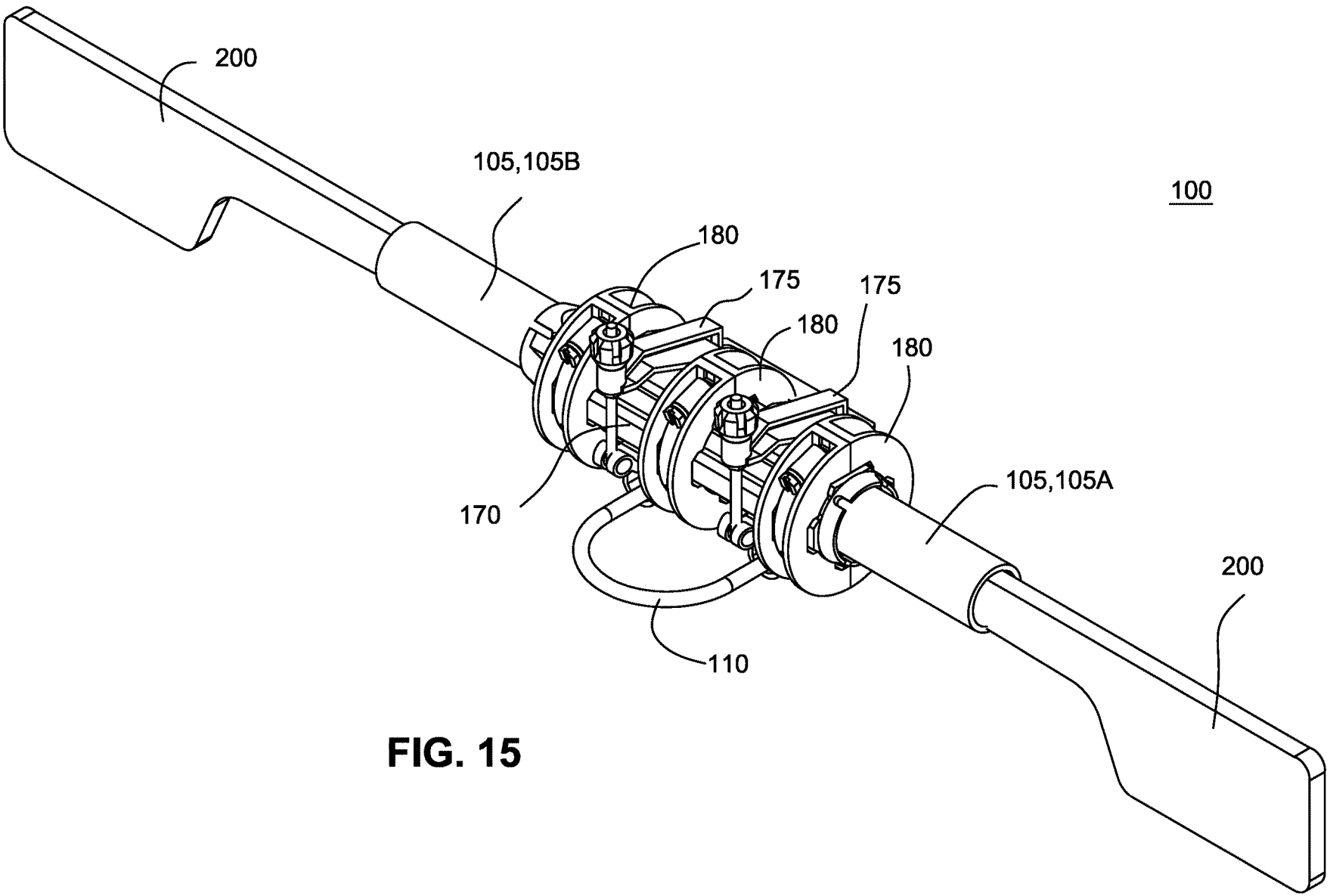
FIG. 15 is a perspective view of another handle for use with a rowing machine.

The configuration illustrated in FIG. 15 includes an additional element in a visual indicator 200. The visual indicator 200 is preferably flat and may have the general shape of an oar blade and provides the benefit of allowing someone that is not using the handle 100 (e.g., a coach or instructor) to visually confirm whether the handle 100 is in the correct position at any point during the stroke and is being moved between positions at the appropriate time during the stroke. This may be particularly useful when a team is practicing on multiple adjacent rowing machines 1000. The visual indicator may be incorporated into all of the disclosed embodiments.

Figure 16:
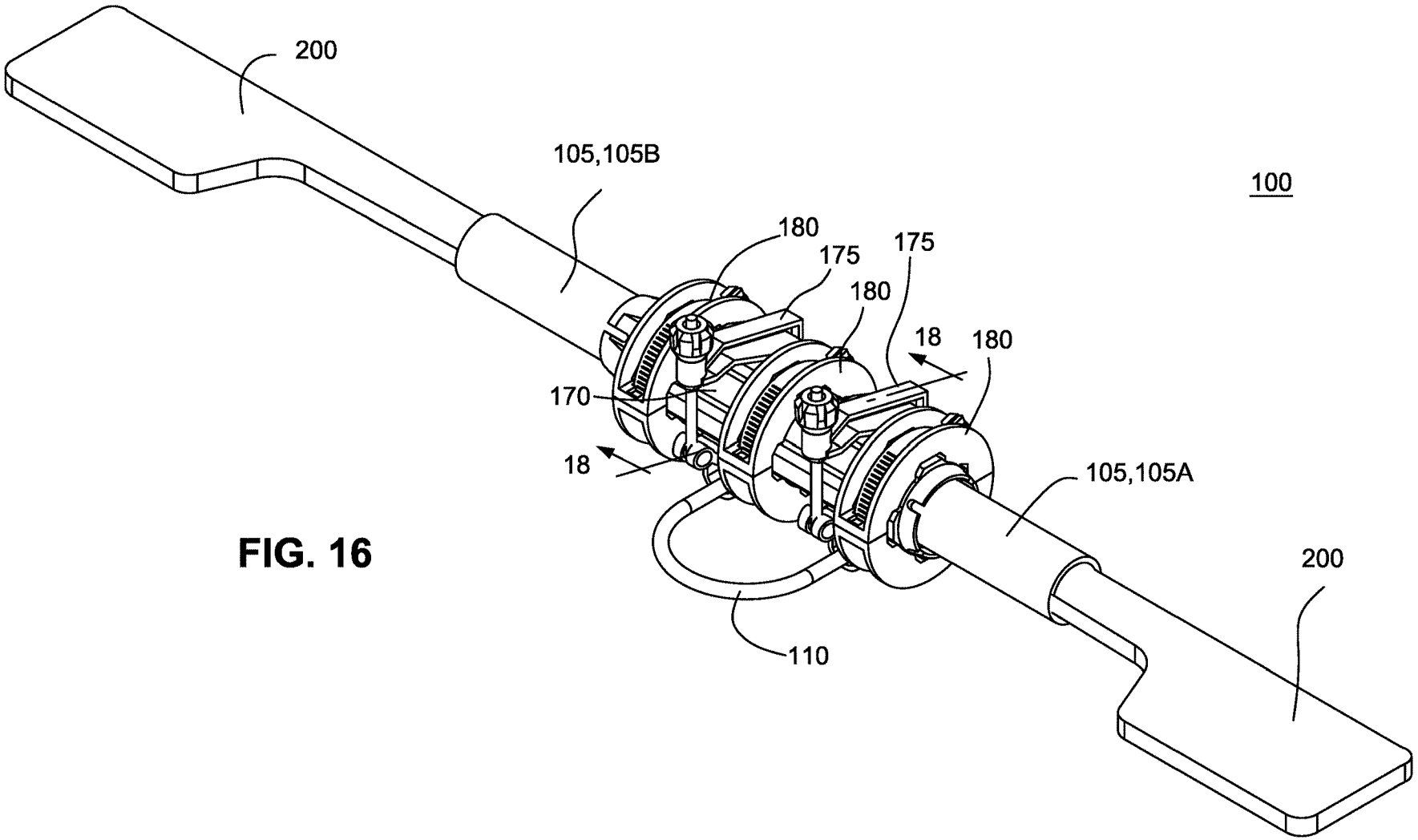
FIG. 16 a similar to FIG. 15 except that components are in a different rotational position.
Figure 17:
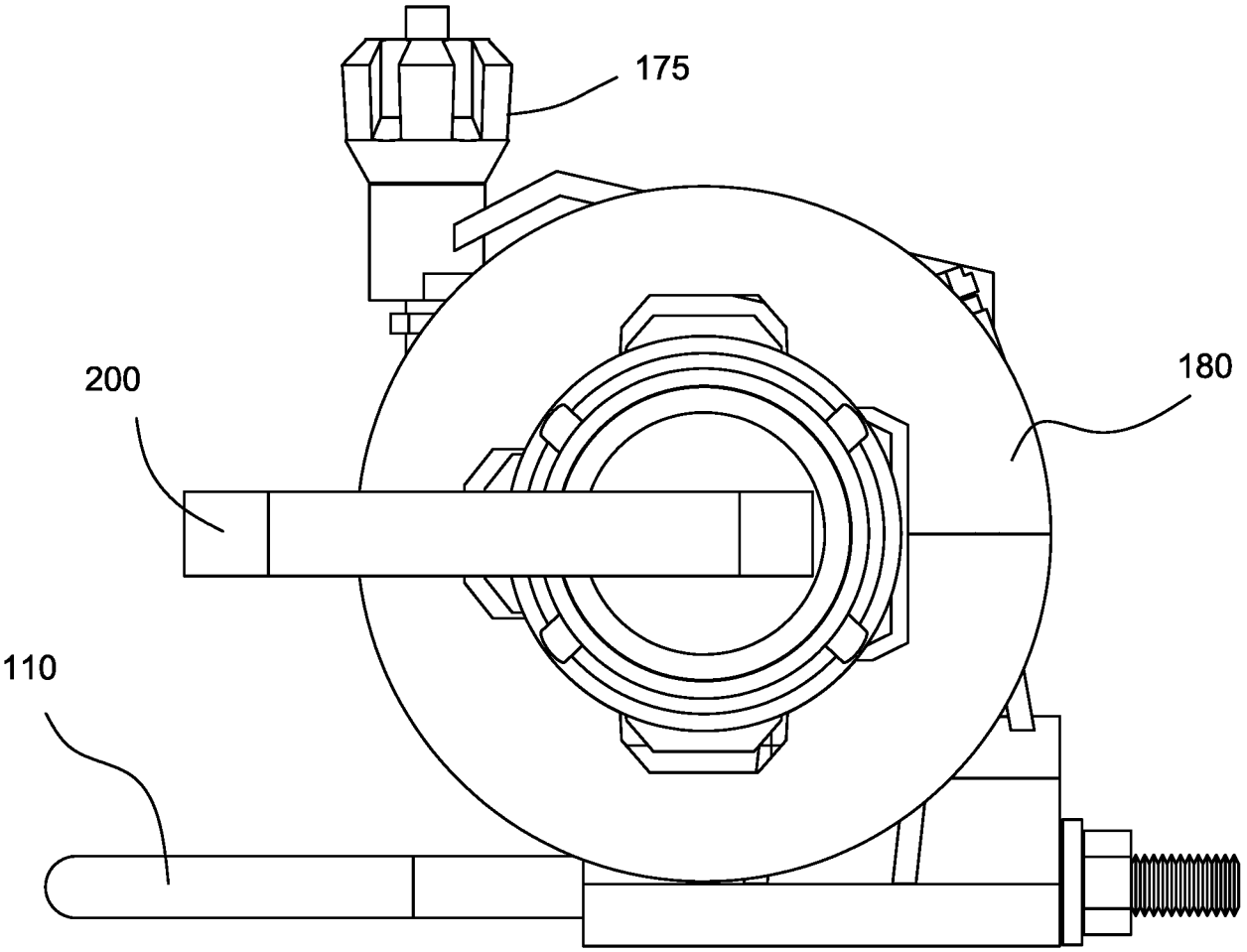
FIG. 17 is an end view of the handle of FIG. 15.

FIG. 16 differs from FIG. 15 in that the position of the visual indicator, and thus the grip member 105, has rotated 90°.

Figure 18:
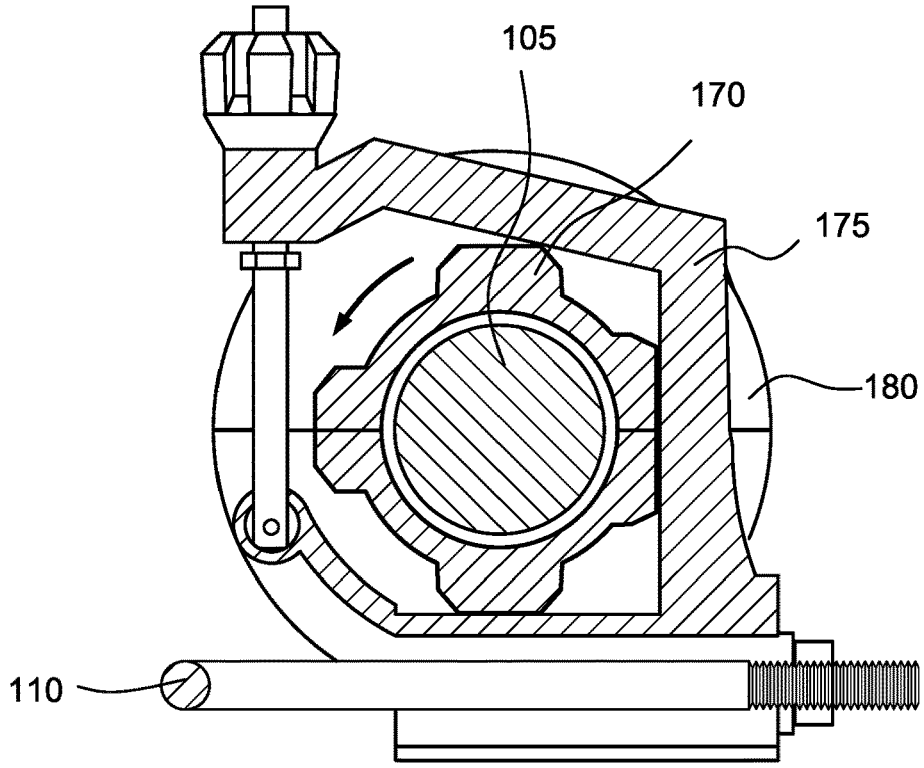
FIGS. 18 and 19 are cross-section views of the handle of FIG. 16, each with a different rotational position of components.
Figure 19:
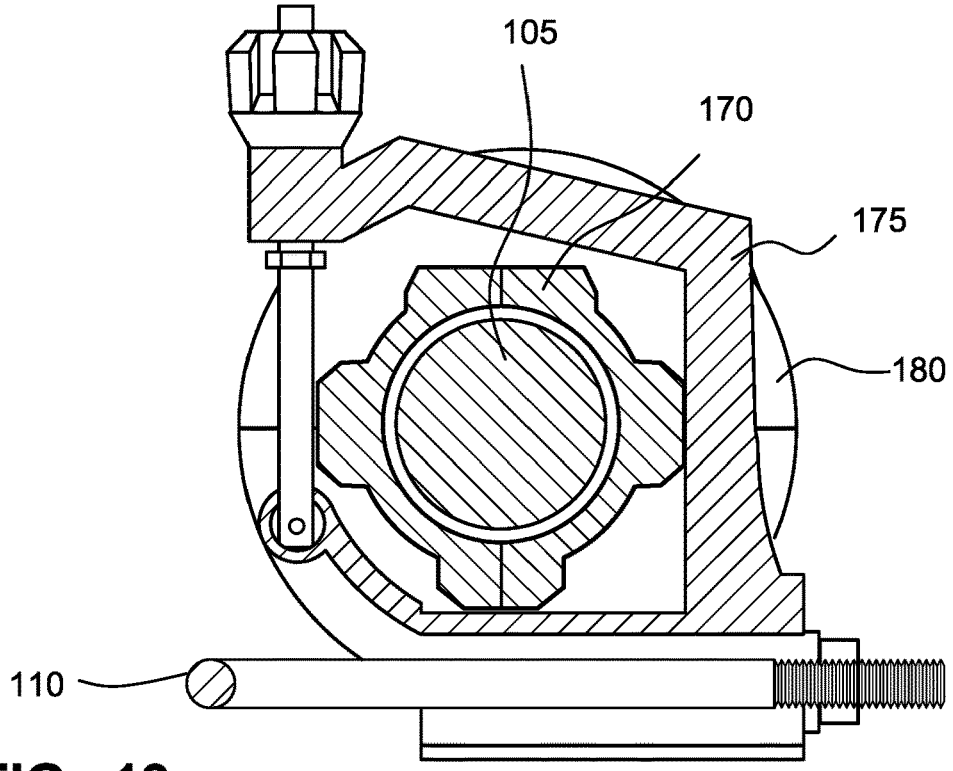
Figure 20:
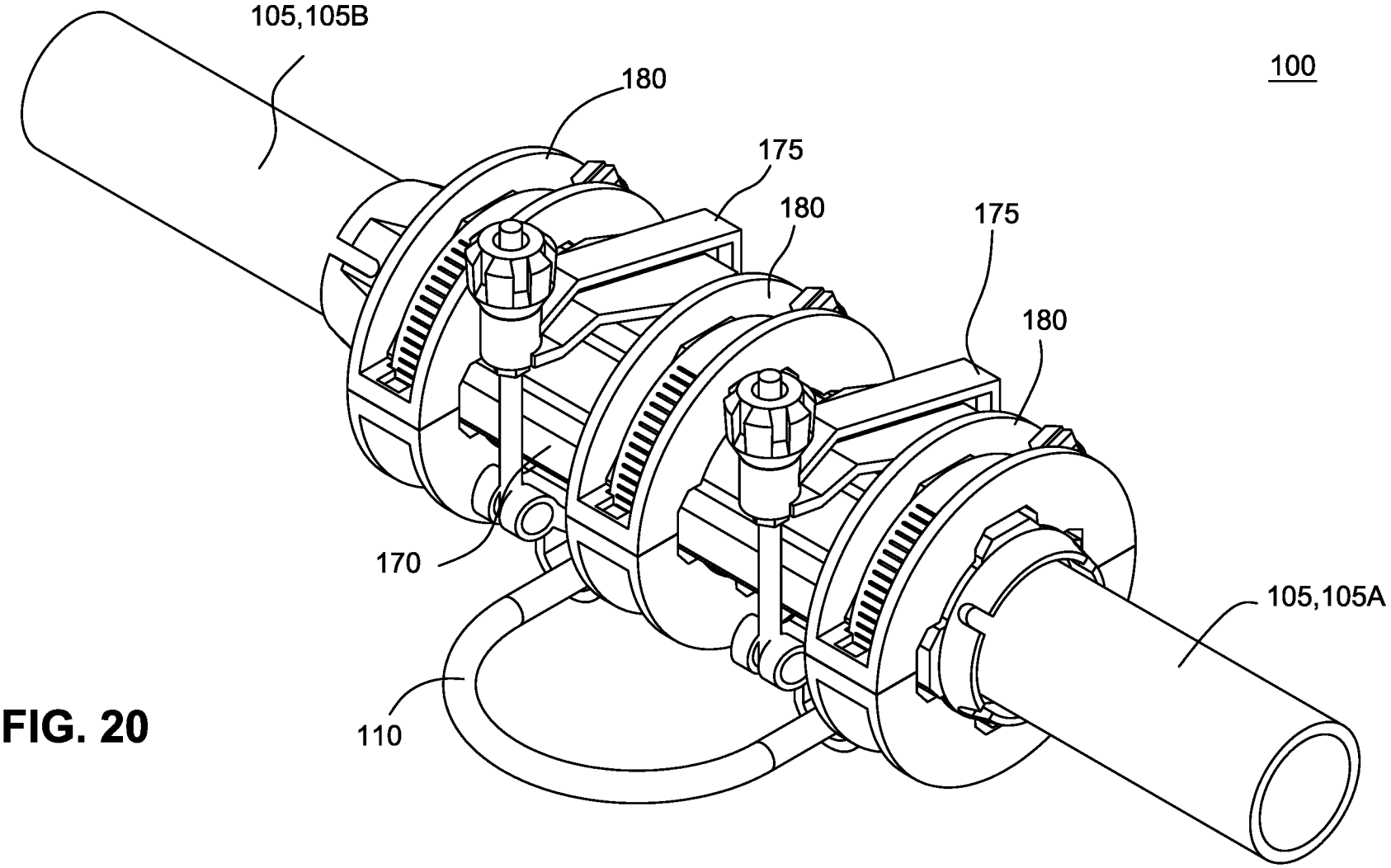
FIGS. 20-25 are various different directional views of the handle of FIG. 15 but with fewer elements for clarity.
Figure 21:
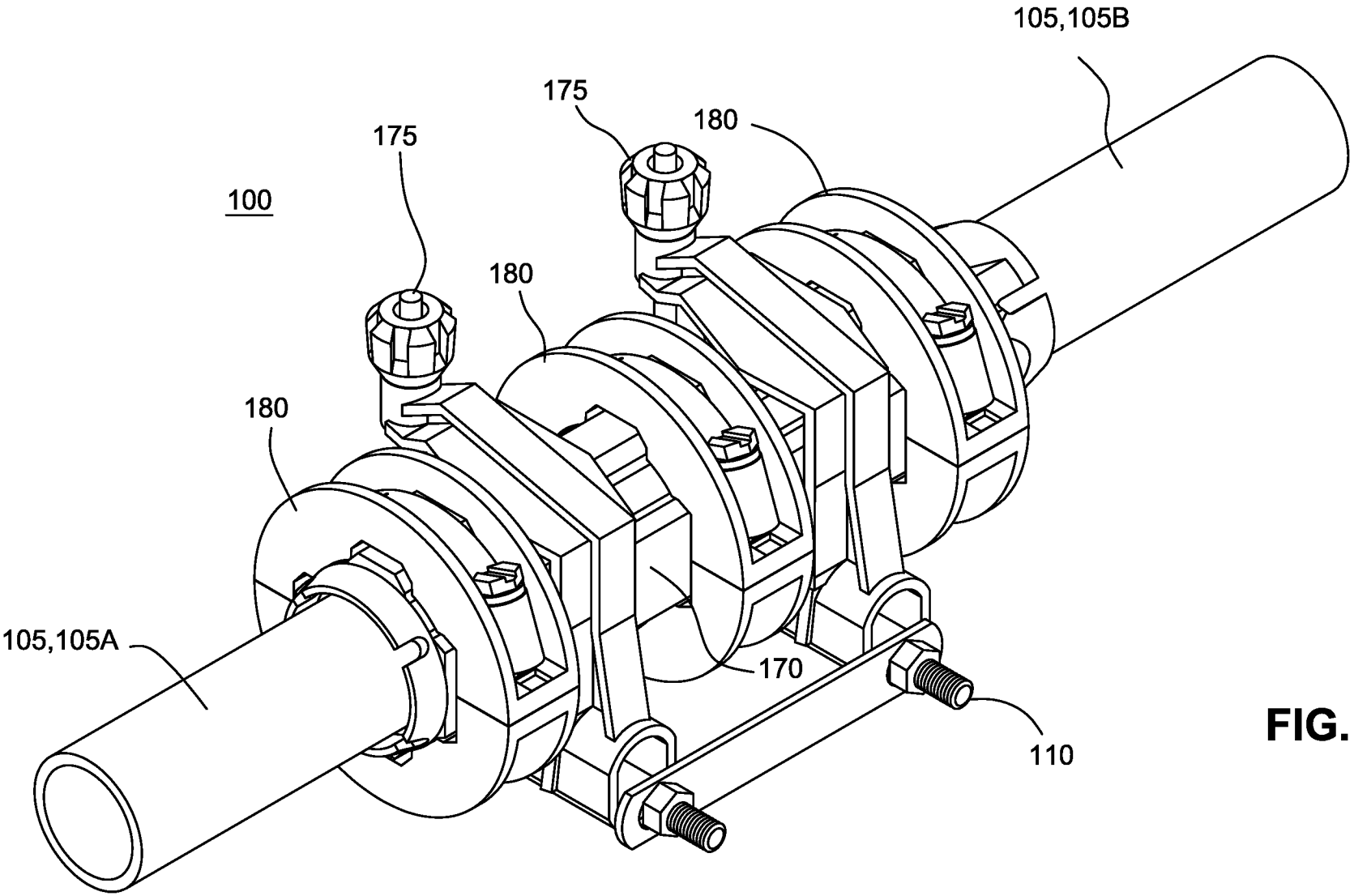
Figure 22:
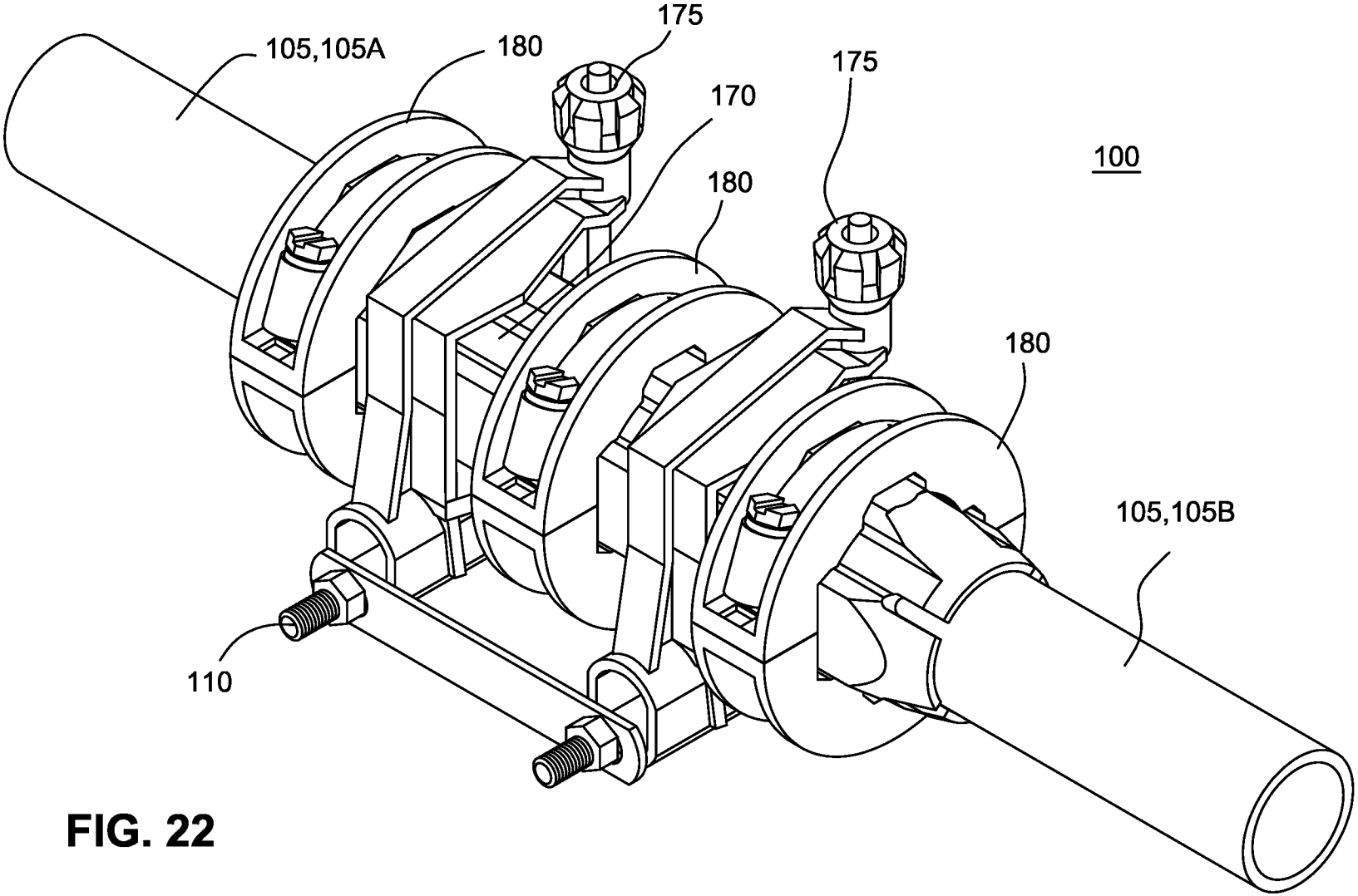
Figure 23:
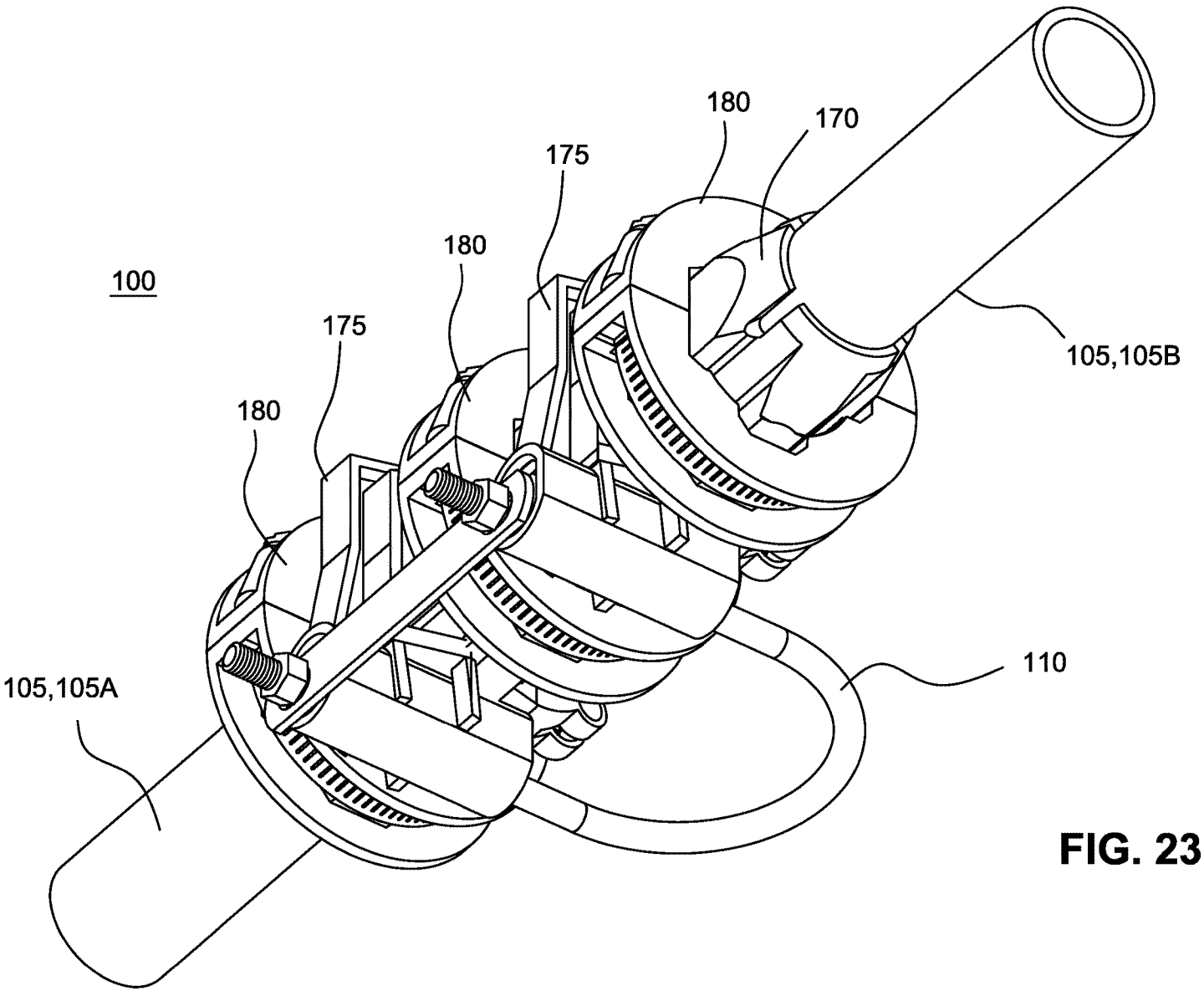
Figure 24:
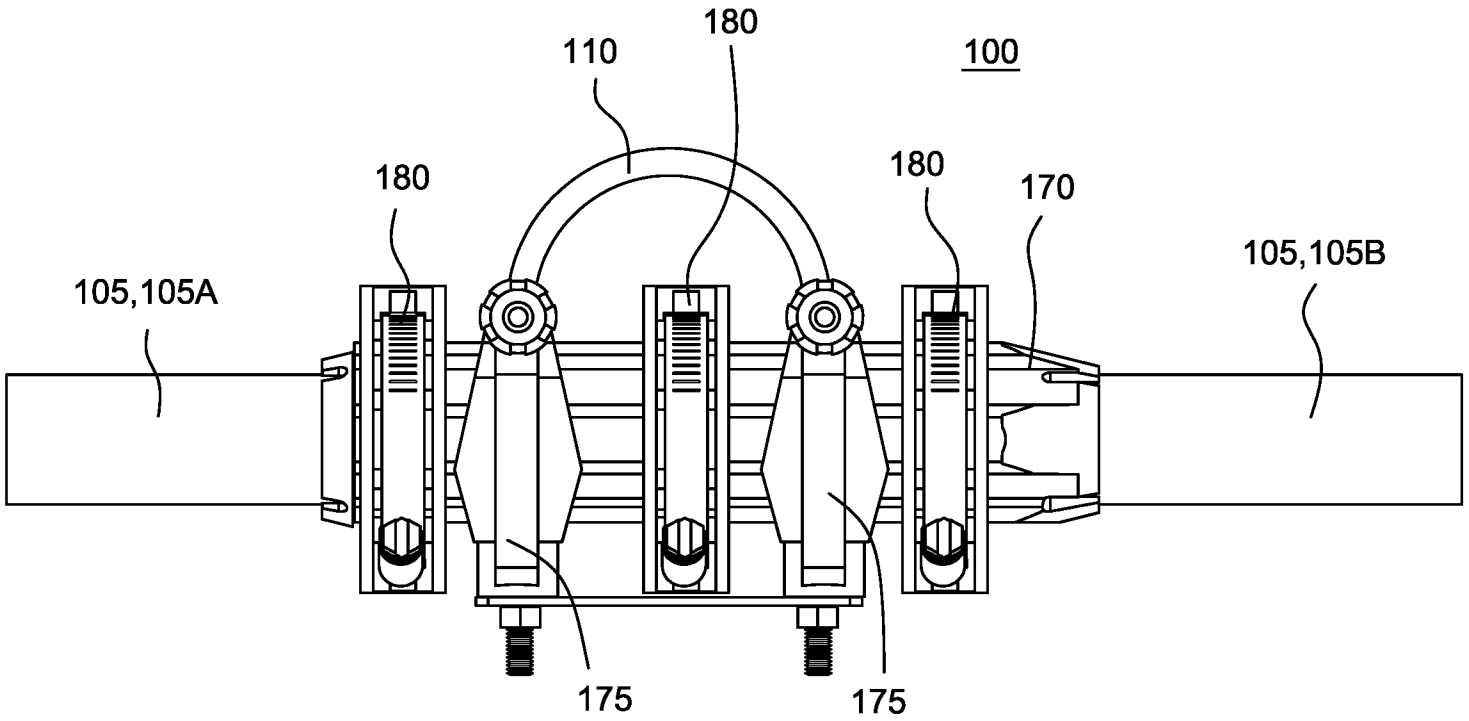
Figure 25:
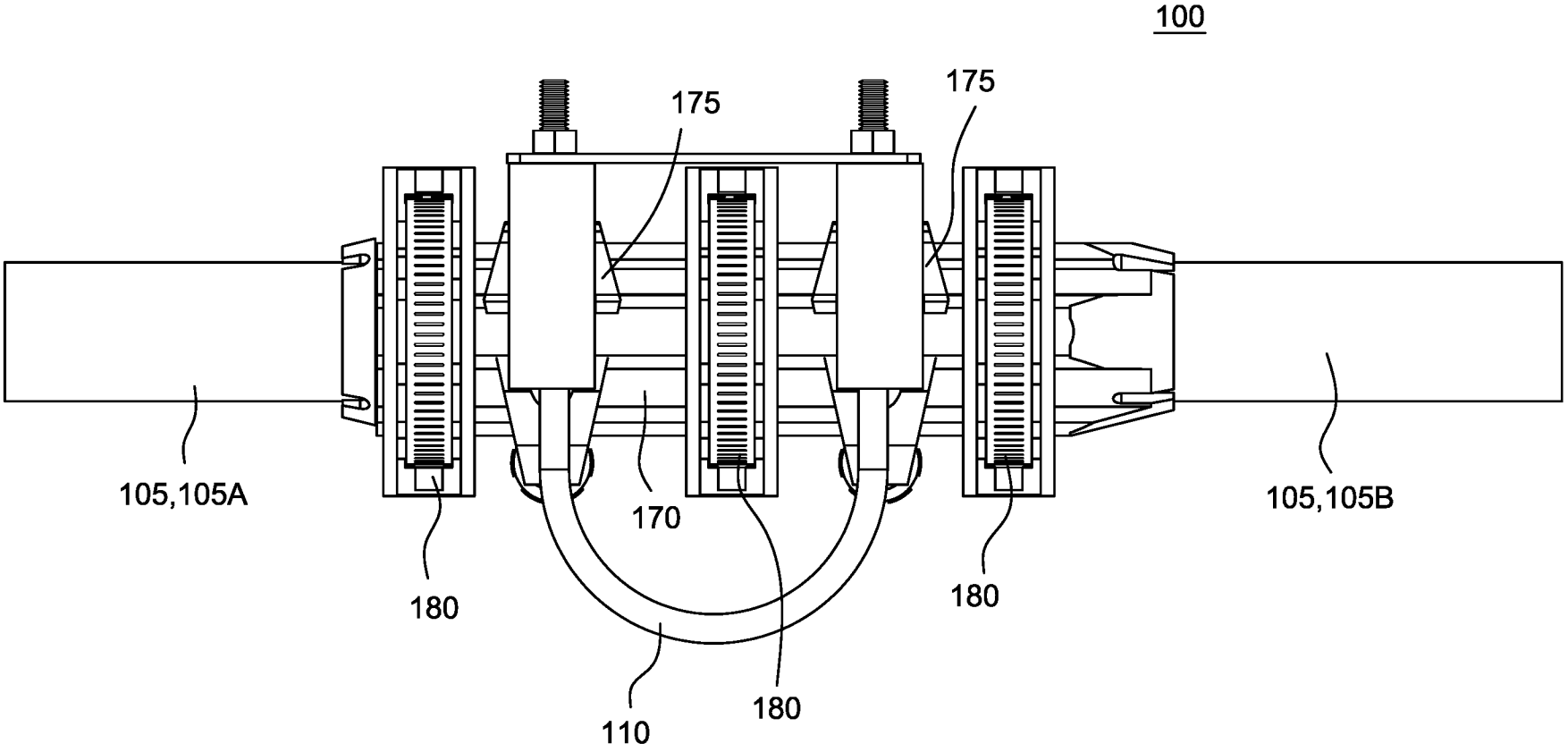

FIGS. 18 and 19 are cross sections that illustrate the grip member 105 in two positions that are rotated 90° relative to one another.

FIGS. 20-25 omit the visual indicator 200.

While the present disclosure has been described in connection with what is presently considered to be the most practical and preferred embodiments, it is to be understood that the present disclosure is not to be limited to the disclosed embodiments, but on the contrary, is intended to cover various modifications and equivalent arrangements included within the spirit and scope of the appended claims.

The invention claimed is:

1. A handle for use with a rowing machine, the handle comprising a right grip portion at a first end of the handle, a left grip portion at a second end of the handle, and a sleeve with a connection for a tensile member, the connection being configured to transmit a force to the handle that is substantially centered between the left grip portion and the right grip portion, wherein the left grip portion is rotationally fixed to the right grip portion such that the left grip portion and the right grip portion rotate in unison with respect to the sleeve, rotation of the left grip portion and the right grip portion from a first position to a second position relative to the sleeve provides at least one of a haptic indication and an audible indication, and the first position and the second position are substantially ninety degrees apart.

2. The handle according to claim 1, wherein the sleeve includes an interior passage extending through the length of the sleeve, the left grip portion and the right grip portion are portions of a continuous member, and the continuous member extends through the interior passage.

3. The handle according to claim 1, wherein the sleeve includes an interior passage extending through the length of the sleeve with a first flat surface and a second flat surface that together form a ninety degree angle and that are both parallel to a central axis of the interior passage.

4. The handle according to claim 3, wherein the right grip portion and the left grip portion are connected by an intermediate portion, and the intermediate portion includes a third flat surface parallel to the central axis that abuts the first flat surface in the first position and abuts the second flat surface in the second position.

5. The handle according to claim 1, further comprising a detent that resists rotation at the first position and at the second position.

6. The handle according claim 5, wherein the detent is part of the sleeve.

7. The handle according to claim 5, wherein the sleeve comprises a first recess that receives the detent at the first position and a second recess that receives the detent at the second position.

8. The handle according to claim 1, wherein the left grip portion and the right grip portion are rotatable 360° relative to the sleeve.

* * * * *